US006457398B1

(12) United States Patent
Wong

(10) Patent No.: US 6,457,398 B1
(45) Date of Patent: Oct. 1, 2002

(54) METHOD AND DEVICE FOR AUTOMATICALLY TURNING AND DISPLAYING MUSIC SHEETS

(76) Inventor: Man Tat Wong, 8 Bordeaux Circuit, Etobicoke, Ontario (CA), M9V 4Z1

( * ) Notice: Subject to any disclaimer, the term of this patent is extended or adjusted under 35 U.S.C. 154(b) by 0 days.

(21) Appl. No.: 09/897,825

(22) Filed: Jul. 3, 2001

(51) Int. Cl.[7] ..... G10G 7/00
(52) U.S. Cl. ..... 89/486; 84/500; 84/502
(58) Field of Search ..... 84/486, 487, 488, 84/489, 490, 491, 492, 493, 494, 495, 496, 497, 501, 500, 502, 504, 507, 516, 517, 511, 514, 515

(56) References Cited

U.S. PATENT DOCUMENTS 5,373,772 A * 12/1994 Shemoul ..... 84/486
5,471,277 A * 11/1995 Fujioka et al. ..... 355/25
5,942,706 A * 8/1999 Leckie ..... 40/518
6,215,058 B1 * 4/2001 Molchak et al. ..... 84/486
6,295,748 B1 * 10/2001 Menke et al. ..... 40/389

* cited by examiner

*Primary Examiner*—Robert E. Nappi
*Assistant Examiner*—Kim Lockett
(74) *Attorney, Agent, or Firm*—David W. Wong

(57) ABSTRACT

The sheet music turning system has a stack of a plurality of rectangular transparent envelopes with their closed end attached to an elongated rod. An opened slot is formed at their opened edge or at two side edges close to the opened edge. The slots are formed in offset locations in alternate envelopes. The music sheets are mounted in the envelopes sequentially. The elongated rod is pivotally mounted in a horizontal position to a lower end of a forward leaning upper frame which has a sliding arm provided at its upper end or at the two sides. The sliding arm has a finger extending over the top edge portion or two fingers extending over the two side edge portions of the stack and being slidable between the offset locations of the opened slots to cause the first envelope to flip forward by gravitational force one page at a time to display the music sheets sequentially one page at a time.

23 Claims, 11 Drawing Sheets

METHOD AND DEVICE FOR AUTOMATICALLY TURNING AND DISPLAYING MUSIC SHEETS

FIELD OF THE INVENTION

This invention relates to a sheet turning method and device for displaying a plurality of sheet material in a sequential manner, and more particularly relates to a method and device for displaying music sheets one page at a time in a sequential manner.

BACKGROUND OF THE INVENTION

It is a common problem for a musician in having to turn or flip the music sheets while playing a musical instrument since the hands of the musician are preoccupied with playing the musical instrument. Many attempts have been made to provide automatic page turning devices which operate to turn the music sheets for the musician without using the hand. However, they are far too complex in construction and do not operate satisfactorily or reliably. Most of such page turning devices such that shown in U.S. Pat. No. 4,072, 080 to D. Conlin or U.S. Pat. No. 4,936,034 to C. J. Chan et al, operate to turn the sheets by mechanical means operating in a horizontal direction either from left to right, or from right to left, such as using a plurality of mechanical swing arms or an annular guide mounted on a rotary shaft for simulating the action of turning the pages by hand. The device must be capable not only in turning the pages sequentially page by page but also to maintain the turned page and the unturned pages fixedly in place so as to display the turned page clearly for reading. Such devices are often subject to jamming and are difficult and time consuming to set up or operate; and they are not suitable for use on a piano or organ.

A device operated by gravitational force for displaying music sheets is shown in U.S. Pat. No. 6,107,558 to W. W. Cowan. In this device, an opening is formed at the top margin of the music sheets through which they are mounted to a threaded spindle shaft. The shaft is turned in steps to cause the sheets to fall one at a time from the spindle and to drop vertically downwards into a lower receiver tray so as to display the music sheets sequentially. The device, however, does not operate reliably since the opening formed in the sheets is subject to tear to cause jamming; and the sheets may not fall or separate positively from the spindle shaft. Sometimes several sheets rather than a single sheet may drop from the spindle. Also, extreme care must be exercised in mounting each sheet to each thread of the spindle shaft sequentially in order to prevent mulfunctioning. Moreover, both the sheets mounted on the spindle and the displayed sheet are not held fixedly so that they may be scattered easily by even very light wind and the displayed sheet may be fluttered by wind to render reading the music difficult. It is also very difficult and time consuming to keep loose sheets in proper order as they may get mixed up very easily. Another drawback of the Cowan device is that the music sheets need to be reshuffled after each performance in order to return the sheets back to their original order so that they will be ready for the next performance.

SUMMARY OF THE INVENTION

It is a principal object of the present invention to provide a music sheets turning device operated by gravitational force for turning or flipping the sheets in a vertical direction in a sequential manner positively and reliably It is another object of the present invention to provide a music sheets turning device which is capable of handling any original documents, either sheets, music book, or other sources of any size, by photocopying the original upon one side of a sheet only.

It is another object of the present invention to provide a music sheets turning device which is not subject to jamming.

It is another object of the present invention to provide a music sheets turning device which is versatile and is suitable for use by musicians playing the various types of musical instruments.

It is still another object of the present invention to provide a modular music sheets mounting means for maintaining, organizing and storing music sheets, which can be loaded to and unloaded from the sheets turning portion of the device easily and quickly at any time.

It is yet another object of the present invention to provide a music sheets turning device which is simple in construction yet is reliable and is easy to set up and operate.

The method of the present invention briefly comprises creating a stack of a plurality of transparent envelopes in which each envelope has an opened end, two closed side edges, and a closed bottom end. The closed end of the envelopes are attached to an elongated rod whereby the envelopes are turnable relative to the elongated rod. The elongated rod has two end portions extending beyond the two closed edges of the envelopes of the stack. The music sheets are enclosed in the envelopes with one sheet located in one envelope in a sequential manner. A first opened slot is formed in a first location of a selected one edge portion of the opened end or the two closed side edges of the odd number of envelopes, and a second opened slot is formed in a second location of a corresponding selected one edge portion of the opened end or the two closed side edges of the even number of envelopes. The stack is mounted on a top forward leaning upper frame with the elongated rod rotatably mounted in a substantially horizontal manner to a lower end of the upper frame. A slider arm is slidably mounted to the upper frame. The slider arm has a cantilever finger extending over the edge portion of the stack of envelopes at which the first and second opened slots are positioned. The cantilever arm retains the stack mounted on the upper frame when the finger is not aligned with either the first location or the second location. The slider arm is movable slidably to position the cantilever finger between the first location and the second location alternately and sequentially such that when the finger is positioned at the first location, the first envelope having the opened slot formed therein at the first location and containing the first sheet of the music sheets will turn or flip downwards past the cantilever finger to fall, by gravitational force, onto a lower display frame to display the first page of the music sheets, and subsequently when the finger is positioned at the second location, the second envelope having the opened slot formed therein at the second location and containing the second sheet of the music sheets will turn or flip downwards past the cantilever finger to fall, by gravitational force, over the first envelope now lying on the display frame. In this manner, the music sheets are displayed page by page in a sequential manner.

BRIEF DESCRIPTION OF THE DRAWINGS

Other objects and advantages of the present invention will become apparent from the following detailed description of the preferred embodiments thereof in connection with the accompanying drawings, in which.

DETAILED DESCRIPTION OF THE PREFERRED EMBODIMENTS

Figure 1:
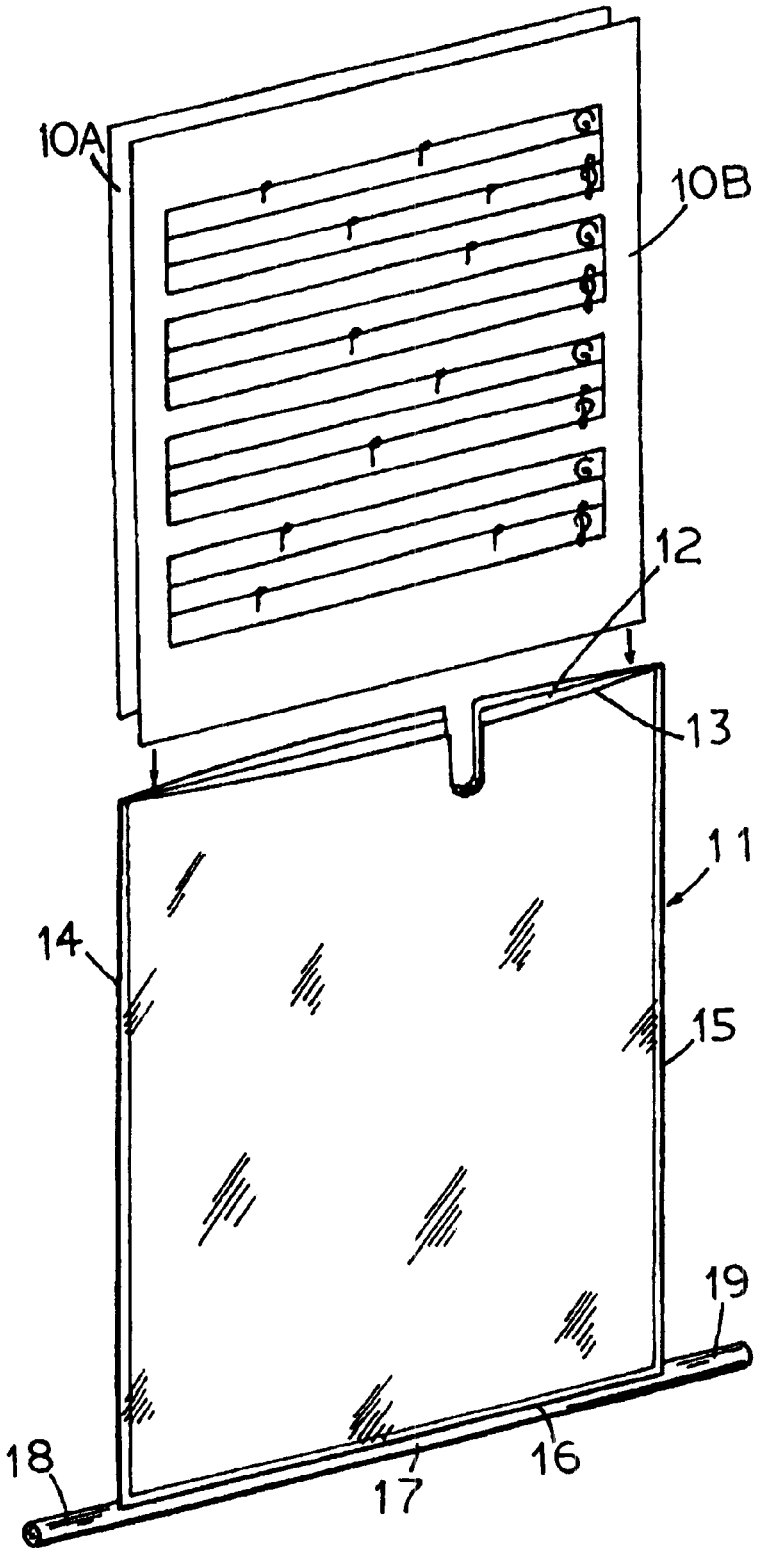
FIG. 1 is a perspective front elevation view of the stack of transparent envelopes having an opened vertical slot formed in its opened upper edge portion according to the present invention.

With reference to the drawings wherein like reference numerals designate corresponding parts in the several views, the music sheets 10 in the present invention are enclosed within a stack of a plurality of thin transparent plastic envelopes 11, with the music sheets inserted in the envelopes in a sequential manner. Each stack of envelopes can accommodate up to a maximum of two songs 10A(first song) and 10B (second song). The number of envelopes in a stack determines the maximum number of music sheets that the stack can accommodate for each song. If only one song is to be displayed, the music sheets are inserted in sequence with one sheet in one envelope starting from the first envelope. The music sheets are inserted in the envelopes with the music facing the rear side of the envelopes and in an upside down orientation. This manner of loading the music sheets into the envelopes will facilitate the music to be shown in the normal right side up orientation when they are displayed, which will become apparent in the description below. If the same stack is to be used for displaying two songs one after the other, the sheets of the second song are inserted into the envelopes sequentially with one sheet in one envelope by first turning the stack around so that the last envelope for the first song becomes the first envelope for the second song. The sheets of the second song are then loaded into the envelopes in the same manner as for the first song with its sheets located back to back to the sheets of the first song in the reverse order of the first song. With the two songs loaded into the same stack of envelopes in this manner, after the sheets of the first song have been completely displayed, the stack may be simply turned around for displaying the sheets of the second song. An additional card board 12 may be provided between the two music sheets 10A and 10B in each envelope for increasing the rigidity and the gravitational weight of the envelopes. The advantage of the latter will become apparent from the description below.

Each envelope 11 has an opened top side 13, and two closed sides 14 and 15, and a closed bottom side 16 which is attached to an elongated rod 17 and the envelopes 11 are turnable or flippable relative to the elongated rod 17. The two end portions 18 and 19 of the elongated rod 17 extend beyond the closed sides 14 and 15 of the envelopes respectively.

Figure 2:
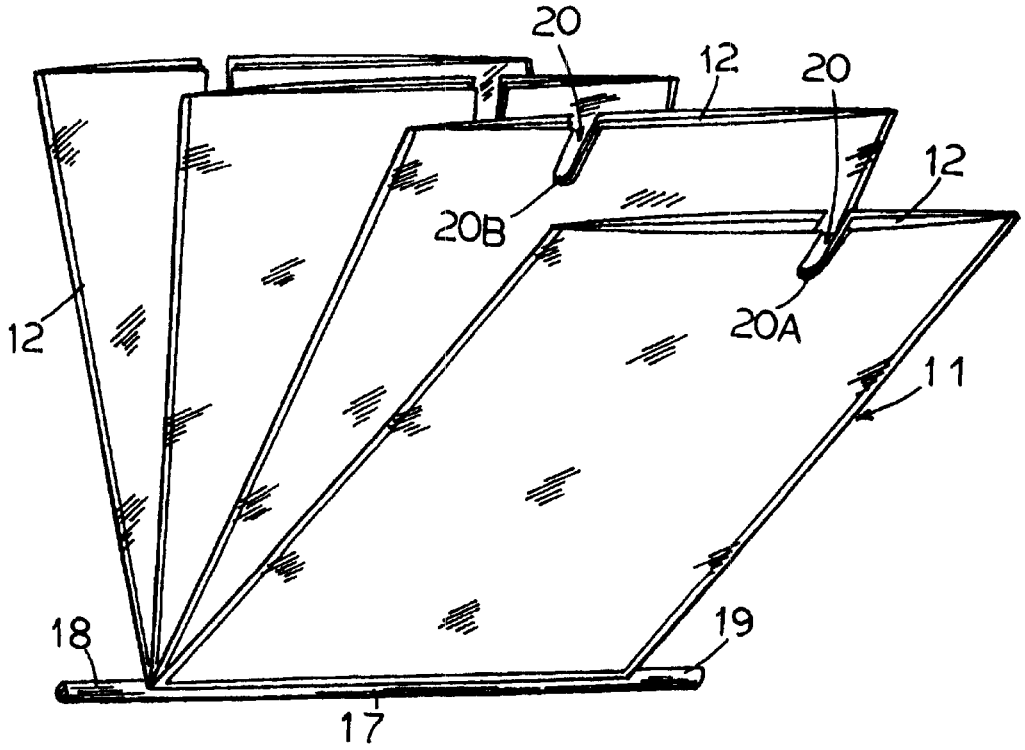
FIG. 2 is a perspective front elevation view of the stack of transparent envelopes with the opened slot formed in offset locations in alternate envelopes.

A vertical opened slot 20 is formed at a first location 20A for all the odd number envelopes and at a second location 20B for all the even number envelopes as best shown in FIG. 2. The first and second locations 20A and 20B of the opened slots are offset from one another.

Figure 3:
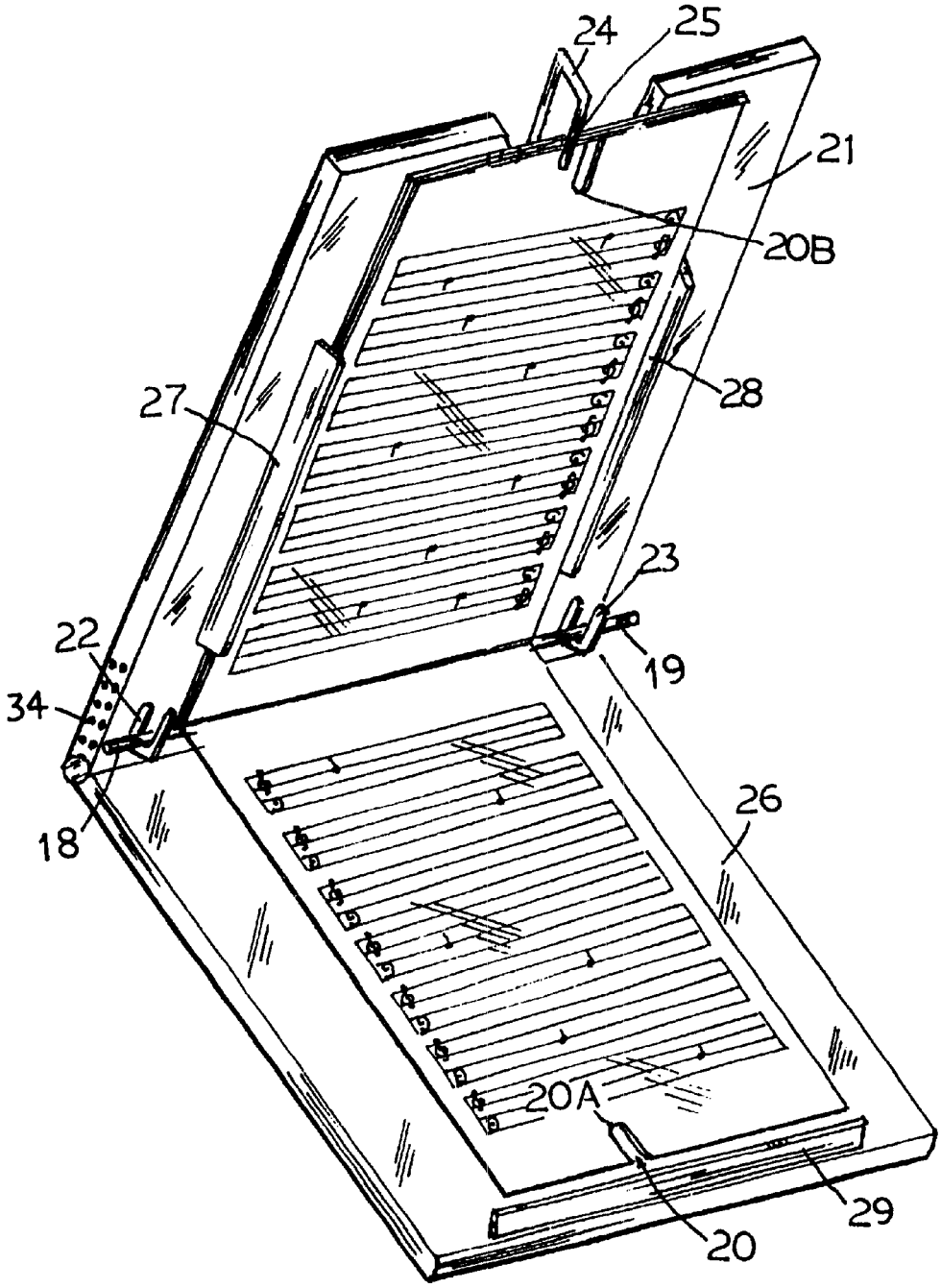
FIG. 3 is a perspective front elevation view of the device according to the present invention with the stack envelopes mounted on a support frame having a forward leaning upper frame.

The stack of envelopes 11 is mounted on an upper frame 21 which leans forwardly at its upper end at a slight angle about 5 to 15 degrees from the vertical plane. The elongated rod 17 is removably mounted in a substantially horizontal position by engaging its two end portions 18 and 19 with two mounting brackets such as the U-shaped brackets 22 and 23 respectively located at a lower end of the upper frame 21 as best shown in FIG. 3. Due to the forward leaning position of the upper frame 21, the stack of envelopes 11 tends to turn or flip forwards relative to the upper frame 21 by gravitational force with the elongated rod 17 serving as its turning shaft. A substantially inverted U-shaped slider arm 24 is slidably mounted on the upper frame 21. The slider arm 24 has a downwardly pointing finger 25 extending over the upper edge portion of the envelope stack which becomes resting against the finger 25 such that the finger 25 will retain the stack of envelopes 11 securely in place on the upper frame 21. The slider arm 24 is slidable sideways such that the finger 25 may be slidably positioned between the first and second locations 20A and 20B. When the finger 25 is first slidably positioned at the location 20A at which the opened slot 20 of the first envelope is located, the latter is no longer supported by the finger 25 and it will turn pass the finger 25 by gravitational force to fall onto the lower display frame 26. Thus, the music sheet mounted in the first envelope is displayed at the lower display frame 26 in the right side up manner. In the meantime, the remaining envelopes 11 of the stack on the upper frame 21 will still be supported by the finger 25 to remain securely in place. The slider arm 24 is then moved sideways slidably to position the finger 25 to the second position 20B such that it will be positioned at the opened slot 20 of the second envelope, and the second envelope will then become not supported by the finger 25 and it will turn or flip downwards past the finger 25 to fall on to the first envelope located on the lower display frame 26; and the second page of the music sheets mounted in the second envelope will thus become displayed at the lower display frame 26. In this manner, the pages of the music sheets will be sequentially displayed by sliding the finger 25 back and forth between the locations 20A and 20B alternately. The operation is carried out positively and automatically by allowing the envelopes to turn or flip downwards page by page by gravitational force without any possibility of jamming or mis-feeding to occur.

Two elongated vertical fence abutments 27 and 28 are provided on the upper frame 21 and positioned juxtaposed to the two side edges of the stack of envelopes 11 so as to prevent the stack from moving sideways when it is mounted on the upper frame 21 in order to maintain that the first and second locations 20A and 20B of the envelopes 11 will not change relative to the upper frame 21. The finger 25 has a relatively narrow width relative to the width of the opened slot 20 so that small changes in the sideway locations of the opened slot 20 are tolerable.

A horizontal guard 29 is provided at the lower end of the lower display frame 26 as a precautionary measure for preventing the music sheets from accidentally falling out of the envelopes 11 when they are in the displayed position on the downwardly sloping lower display frame 26.

The upper frame 21 and the lower display frame 26 are hingedly mounted together such that they may be folded together conveniently for storage or transporting.

The mechanism for operating the slider arm 24 is located in an enclosure 30 located at the rear of the upper frame 21. The construction of this mechanism will be described in later description below.

Figure 6:
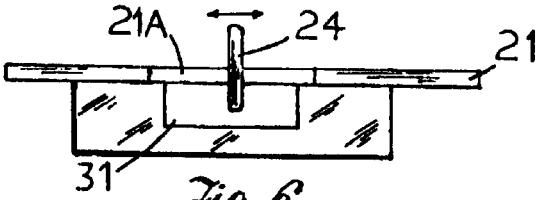
FIG. 6 is a perspective top elevation view of the device shown in FIG. 5.
Figure 5:
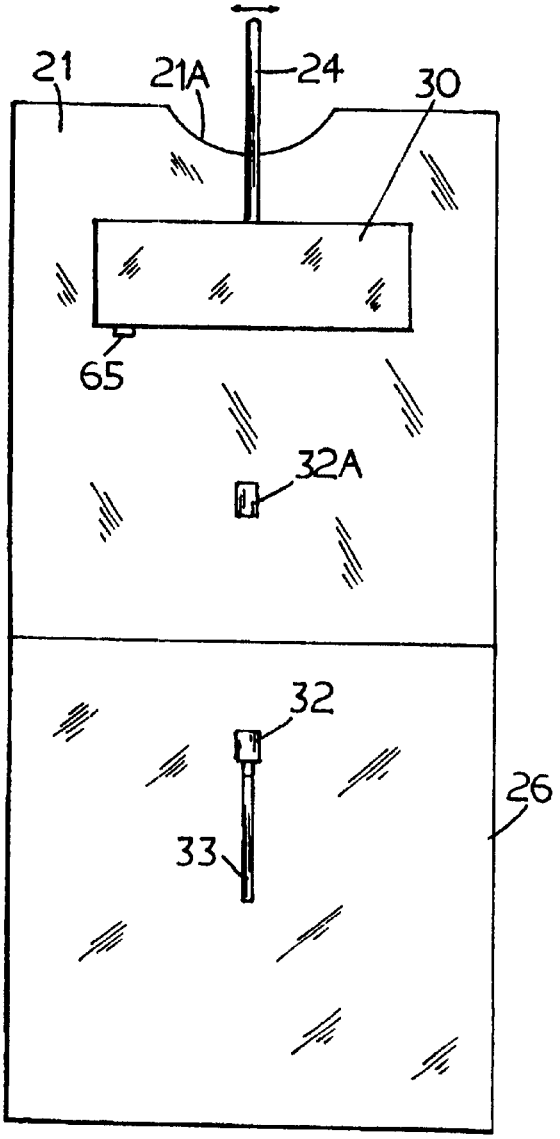
FIG. 5 is a perspective rear elevation thereof
Figure 4:
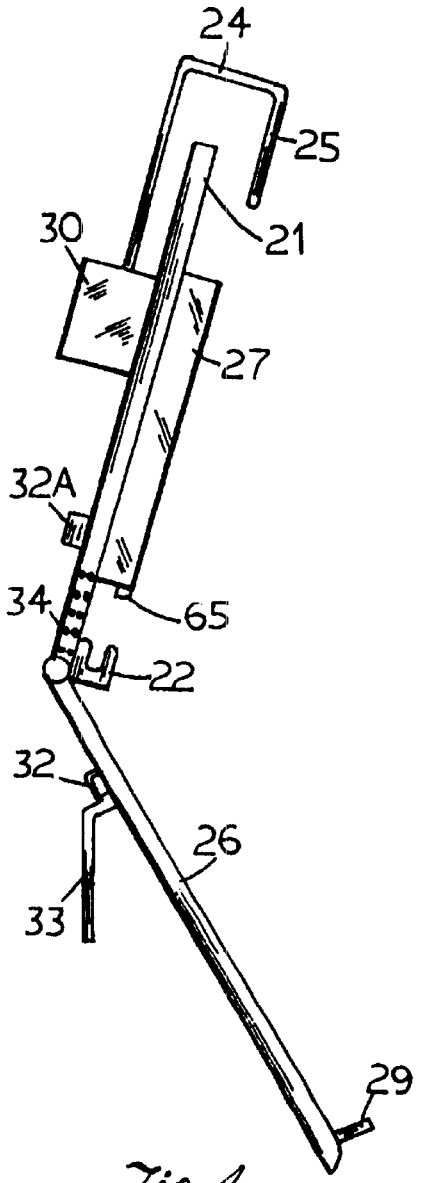
FIG. 4 is a perspective side elevation view of the device shown in FIG. 3.

The slider arm 24 extends upwards from the enclosure 30 through an upper opening 31 formed therein as shown in FIG. 6.

A cut out 21A is formed at the upper edge portion of the upper frame 21 to facilitate the mounting and removal of the stack from the upper frame 21.

A sleeve bracket 32 is provided at the rear surface of the lower display frame 26 and a second sleeve bracket 32A is provided at the rear surface of the upper frame 21 so that a substantially S-shaped pin 33 may be removably inserted into the sleeve bracket 32 or alternatively the sleeve bracket 32A for mounting the device of the present invention on a conventional music tripod or stand. A plurality of pairs of dimples 34 are formed at the lower end portion of both the right and left side edges of the upper frame 21 for mounting a piano or organ docking plate to the device.

Figure 7:
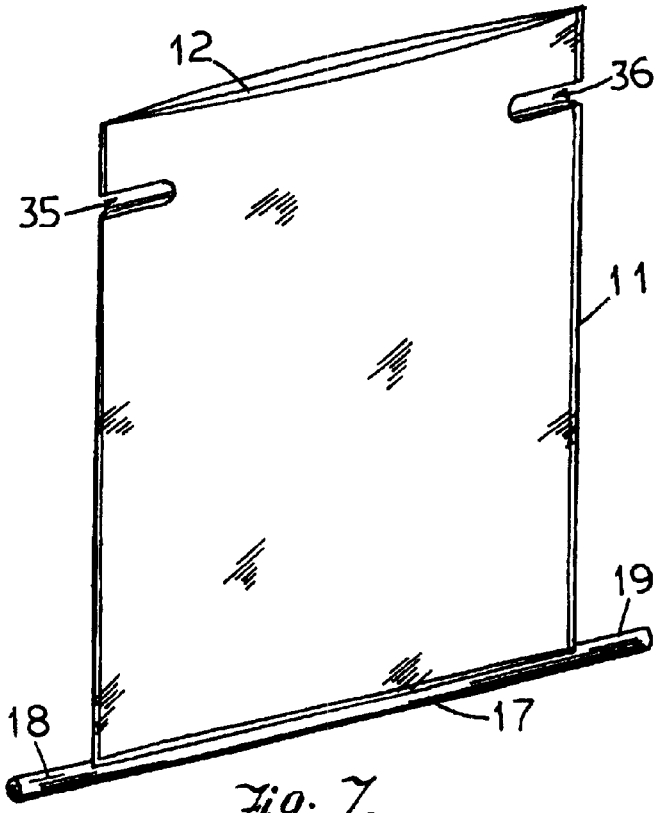
FIG. 7 is a perspective front elevation view of the alternative embodiment of the stack envelopes with opened slots formed in the two side edges adjacent to the top opened edge.
Figure 8:
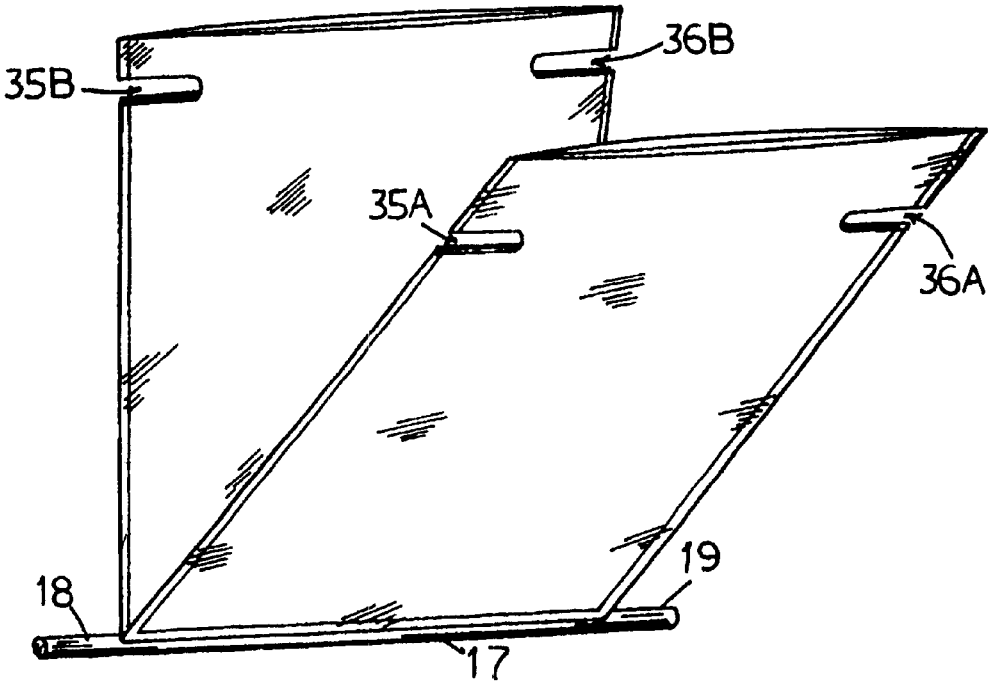
FIG. 8 is a perspective front elevation view of the stack of the alternative embodiments showing the off-set position of the opened slots formed in the alternate envelopes.
Figure 9:
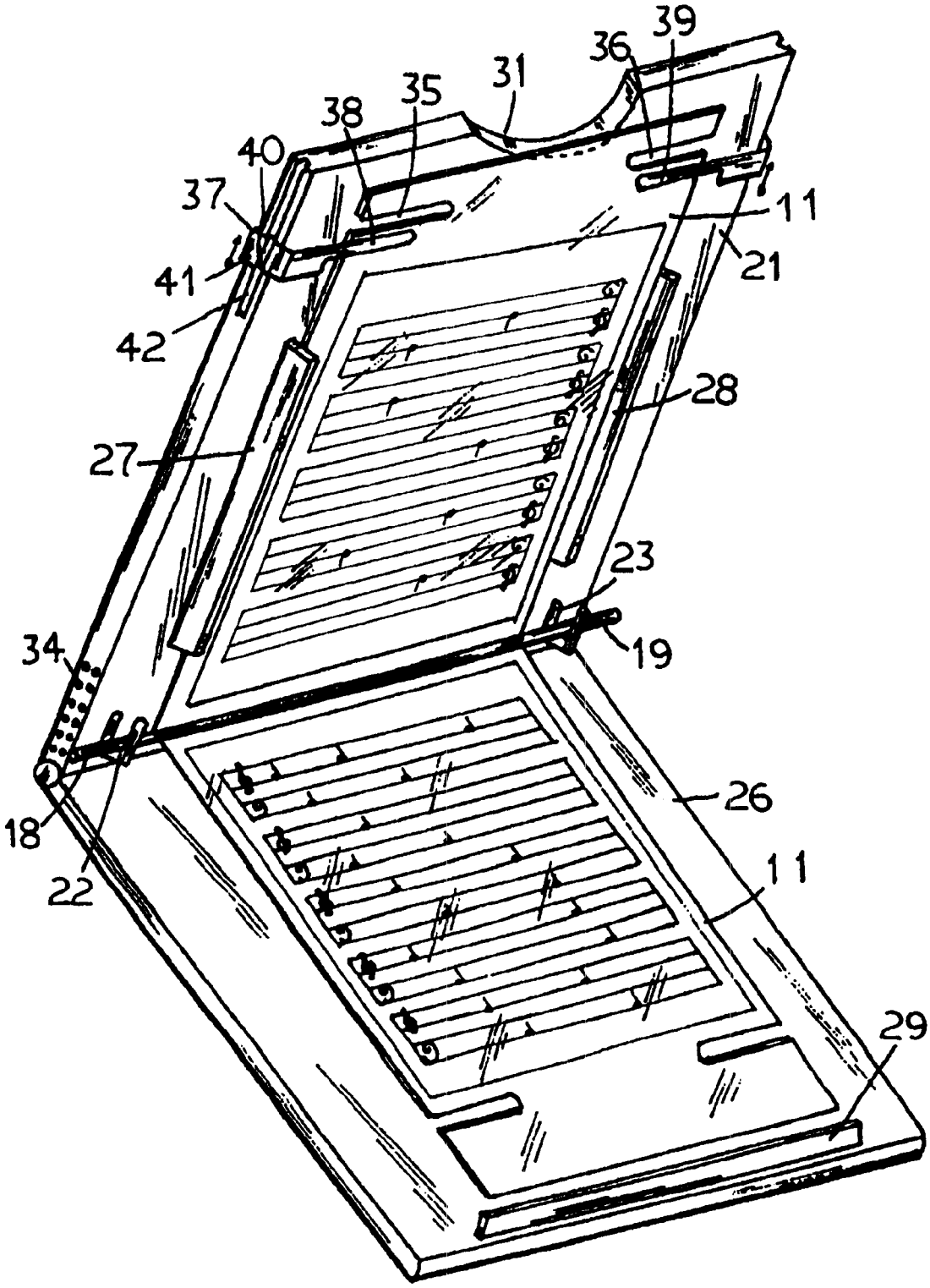
FIG. 9 is a perspective front elevation view of the alternative embodiment of the present invention having a sliding bracket with two arms extending over the side edge portions of the stack.
Figure 10:
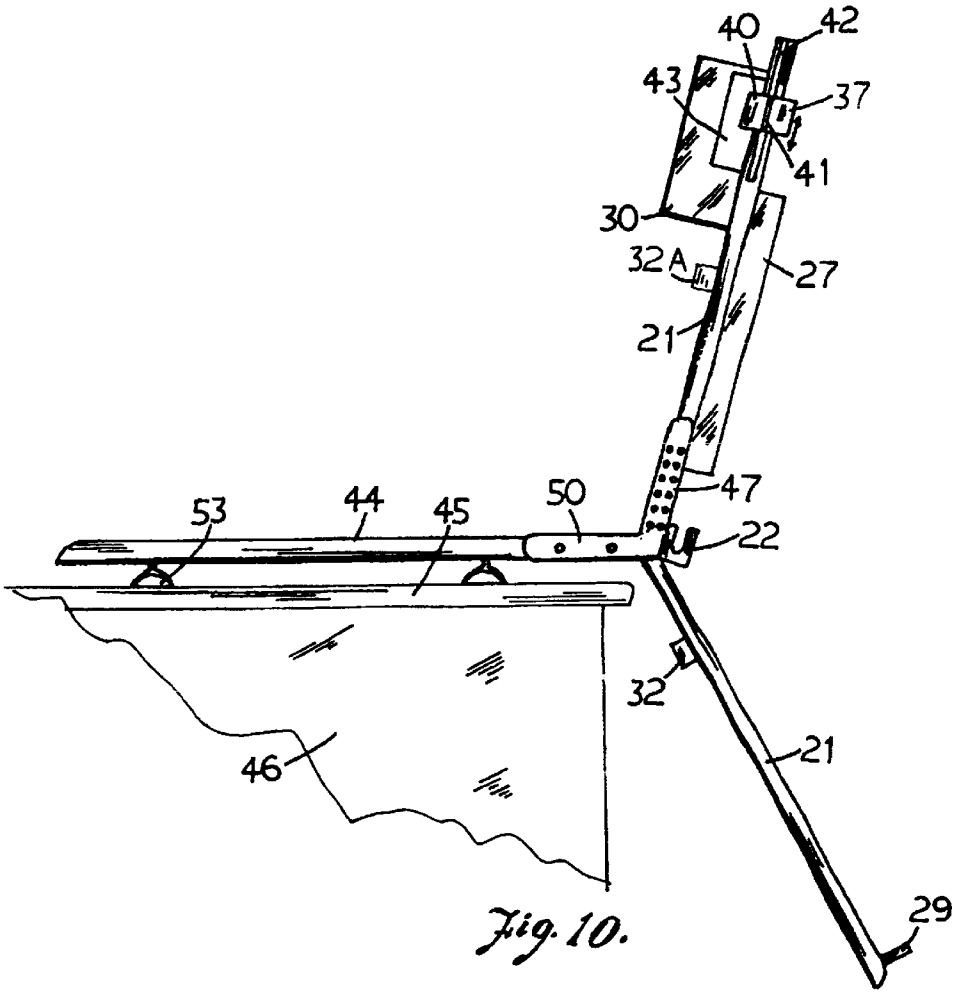
FIG. 10 is a perspective side elevation view of the alternative embodiment provided with a piano docking platform.
Figure 12:
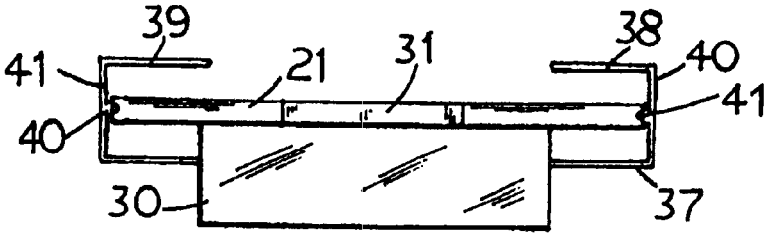
FIG. 12 is a perspective top elevation view of FIG. 11.
Figure 11:
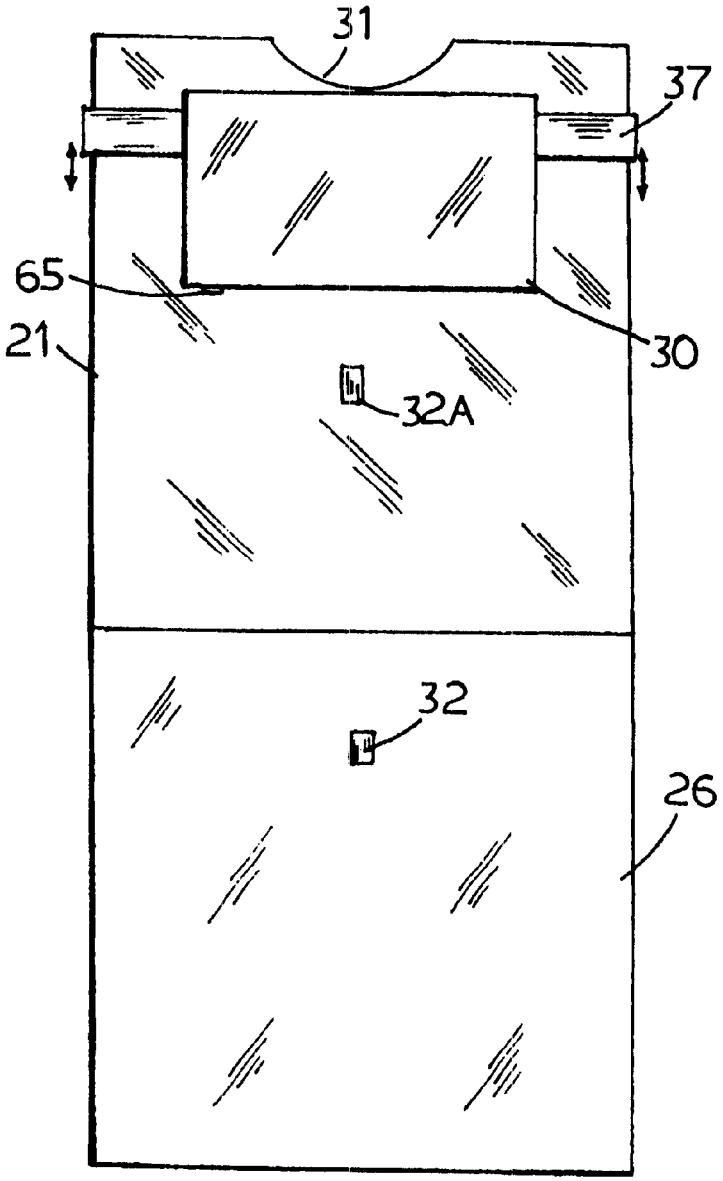
FIG. 11 is a perspective rear elevation view of the alternative embodiment.
Figure 13:
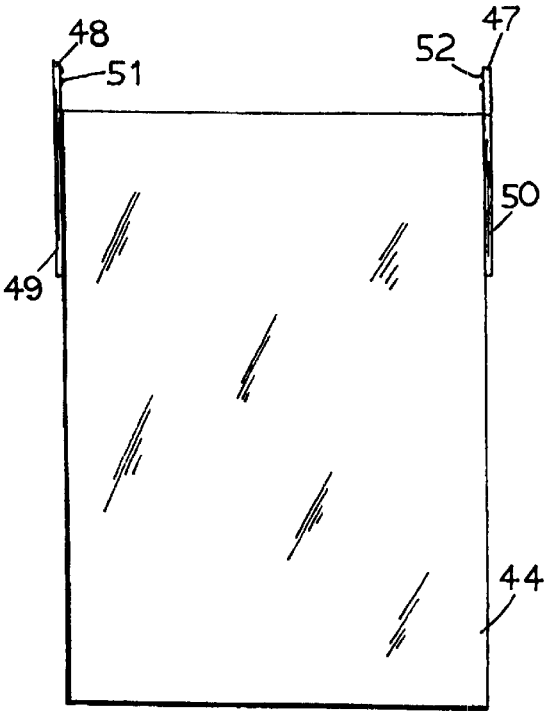
FIG. 13 is a perspective top elevation view of the detachable piano docking platform for the device according to the present invention.
Figure 15:
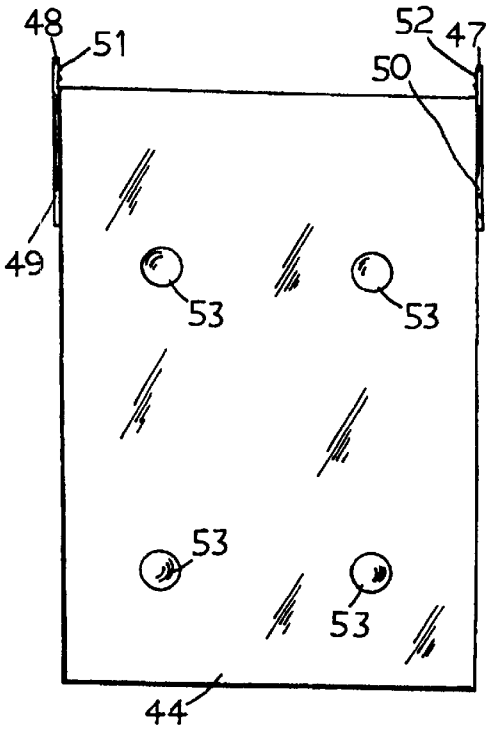
FIG. 15 is a perspective bottom elevation view of the piano docking platform.
Figure 14:
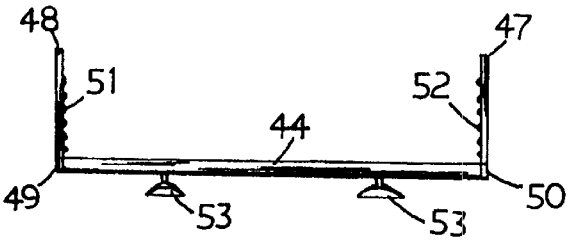
FIG. 14 is a perspective front elevation view of the piano docking platform of FIG. 13.
Figure 16:
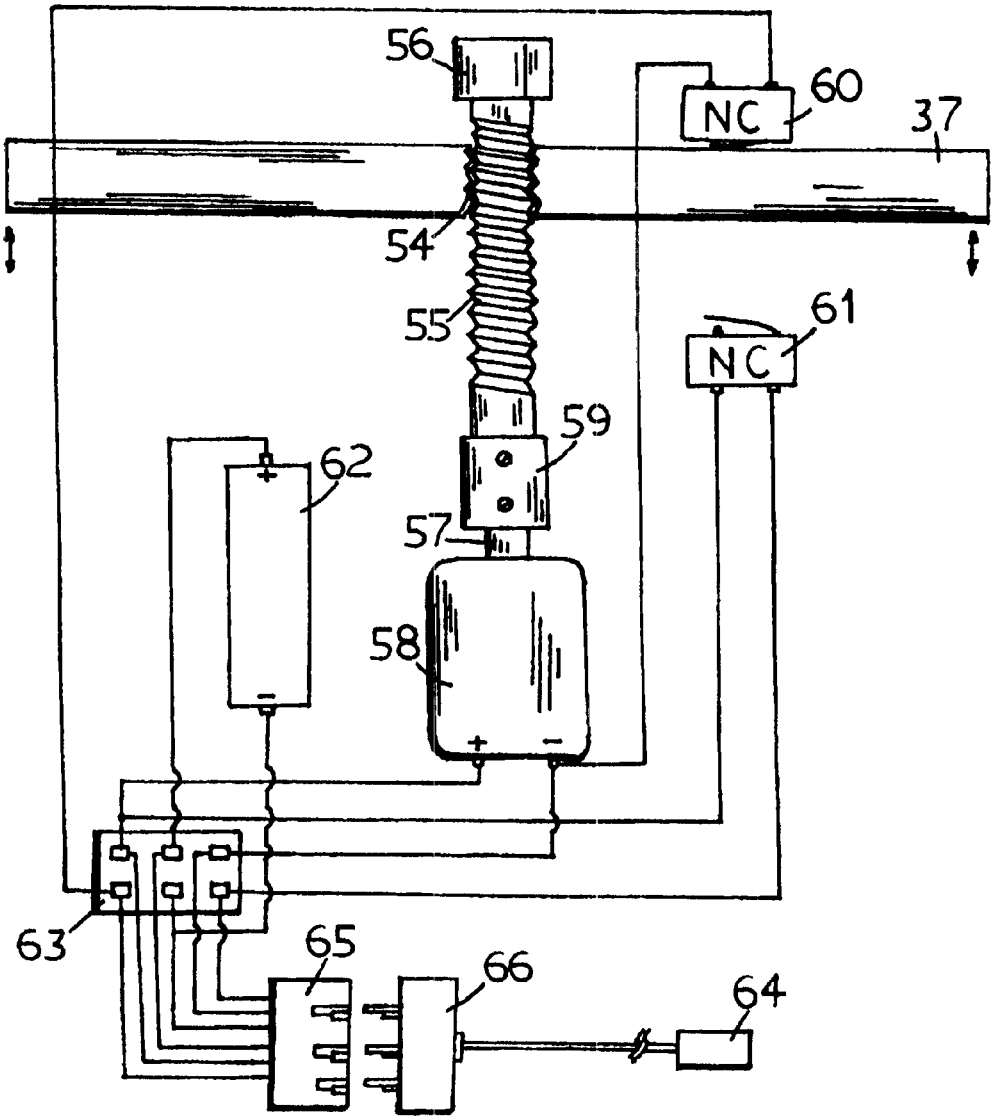
FIG. 16 is a schematic diagram of the electromechanical device provided with a DC motor for operating the sliding arm of the device of the present invention.

A second embodiment of the device of the present invention is shown generally in FIGS. 7 and 8. In this embodiment, two horizontal opened slots 35 and 36 are formed on the two side edges 14 and 15 of the envelopes 11 and are located adjacent to the upper opened end 13. The location of the opened slots of alternate envelopes are offset from one another such that the slots are positioned at one location spaced from the upper opened end 13 for the odd number envelopes and they are positioned at a second location spaced from the upper opened end 13 for the even number envelopes. The slider arm 37 is slidable vertically relative to the upper frame 21 and it has two horizontal fingers 38 and 39 extending over the side edge portions of the stack of envelopes 11 such that upper portion of the stack of envelopes 11 will rest against them due to the forward flipping motion by gravitational force. The slider arm 37 may be slidably positioned between the first and second positions. When they are positioned at the first position, they will be aligned with the opened slots 35A and 36A of the first envelope 11 such that the first envelope will no longer be supported by the fingers 38 and 39 so that the first envelope 11 will turn or flip downwards to the lower display frame 26 by gravitational force while the remaining envelopes of the stack will be retained in place on the upper frame 21 by the fingers 38 and 39. The music sheet 10 in the first envelope 11 now lying on the display frame 26 is shown in the proper upright manner for reading. The slider arm 37 will subsequently be slidable to position the fingers 38 and 39 at the second location at which the opened slots 35B and 36B are positioned such that the second envelope will no longer be supported by the fingers 38 and 39 and it will turn or flip downwards to the lower display frame 26 to display the second page of the music sheets. Thus, in the same manner as in the first embodiment, the slider arm 37 may be moved slidably and alternately between the first and second locations to turn the envelopes one at a time to display the music sheets one by one sequentially.

If a second song is mounted on the front side of the envelopes as described earlier, the stack may be readily and easily removed from the upper frame 21 after all the sheets of the first song have been displayed, and be mounted again to the upper frame 21 in the reverse side such that the second song may then be displayed page by page sequentially by operating the device in the same manner. Furthermore, a plurality of stacks with each stack holding a maximum of two songs may be provided for a plurality of songs such that different songs may be selected quickly and easily for display by the device. The cut out 21A provided at the upper edge of the upper frame 21 facilitates the mounting and removal of the stack from the upper frame 21.

A vertical ridge 40 is formed in both side sections 41 of the slider arm 37, which slidably engages with a short vertical channel 42 formed in both side edges of the upper frame 21 for providing a positive engagement between the slider arm 37 and the upper frame 21. The slider arm 37 extends through an opening 43 formed at both sides of the enclosure 30. The opening 43 has a vertical length allowing the slider arm 37 to move between the first and second locations.

A piano or organ docking plate 44 may be removably mounted to the device by securing it to the top 45 of a piano or organ 46 or similar large free standing musical instrument having a large flat top. Two substantially L-shaped brackets 47 and 48 having horizontal sections 49 and 50 respectively are mounted to the two sides of the front end of the docking plate 44, and having upper sections 47 and 48 respectively which extend at an obtuse angle relative to the horizontal sections 49 and 50 respectively. A plurality of pairs of protrusions 51 and 52 are formed in the inner surface of the upper sections 47 and 48. The docking plate 44 may be removably mounted to the device of the present invention by slidably engaging the protrusions 51 and 52 of the L-shaped brackets 47 and 48 with the lower side edge portions of the upper frame 21. The protrusions 51 and 52 of the brackets 47 and 48 will engage with the dimples 34 at the side edges of the upper frame 21 to provide a secure engagement between the L-shaped brackets 47 and 48 and the upper frame 21. The position of the docking plate 44 relative to the upper frame 21 may be adjusted by sliding the upper frame 21 vertically relative to the brackets 47 and 48 so as to provide a selected mounting position of the device on various types of pianos, organs or similar instruments. Suction cups 53 are provided at the bottom surface of the docking plate 44 for removably attaching it to the top of the piano, organ or similar instrument.

An embodiment of the mechanism for moving the slider arm between the first and second positions is shown in FIG.

16. In this embodiment, a threaded opening 54 is formed at the center of the slider arm 37. The threaded opening 54 is threadingly engageable with a worm shaft 55 which has its top end rotatably mounted to a bearing 56 and its lower end connected to the drive shaft 57 of a DC motor 58 by a sleeve coupler 59. Two normally closed limit switches 60 and 61 are positioned in the enclosure 30 such that when the slider arm 37 is at the first location it will operate the normally closed upper limit switch 60 and when it is at the second location it will operate the normally closed lower limit switch 61. The battery 62 for operating the DC motor 58 is connected to the DC motor 58 through a connection terminal block 63. The DC motor 58 is actuated by a double-pole double-pole switching means 64 which may be connected to the connection terminal block 63 through a 6-position connection socket 65 and 6-position connection plug 66. The switching means 64 may be a conventional foot switch located on the floor, or a push button switch mounted at a convenient location on the piano or organ, or a wireless remote control switch. The 6-position socket 65 and 6-position plug 66 of the switching means facilitates the switching means to be disconnected from the enclosure for convenient storage or transport. The switching means 64 may be actuated for moving the slider arm 37 sequentially and alternately between the first and second locations for displaying the music sheets page by page sequentially as described above.

Figure 17:
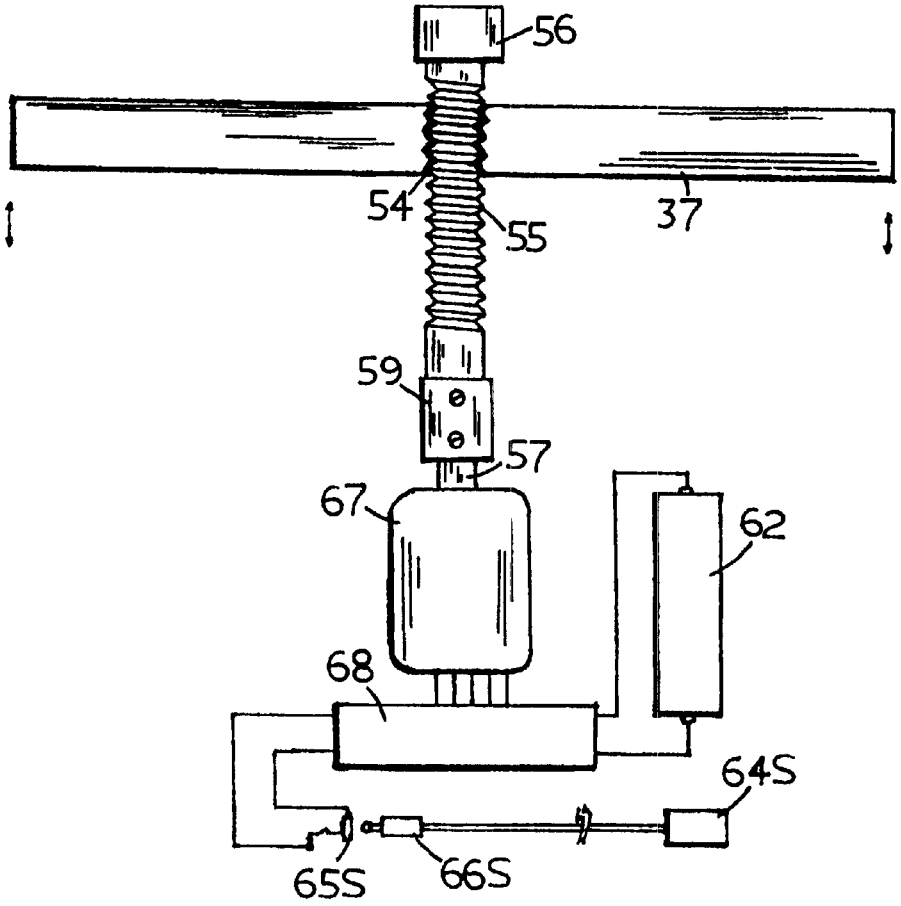
FIG. 17 is a schematic diagram of an alternative electromechanical device provided with a stepper motor for operating the sliding arm.

A second embodiment of the mechanism is shown in FIG. 17. A DC stepper motor 67 is provided in this embodiment, which may be operated to turn in alternate directions sequentially by an electronic control 68 actuated by a single pole momentary switching means 64S. The switching means 64S may be a conventional foot switch located on the floor or a push button switch mounted at a convenient location on the piano or organ, or a wireless remote control. The 2-position socket 65S and 2-position plug 66S of the switching means facilitates the switching means to be disconnected from the enclosure for convenient storage or transport.

Figure 18:
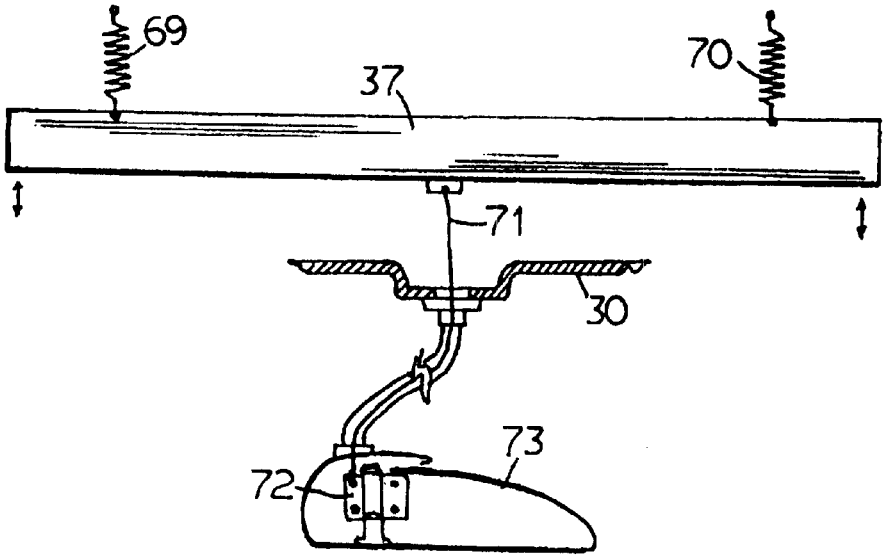
FIG. 18 is a schematic diagram of a mechanical device provided with a mechanical double action latch for operating the sliding arm.

A mechanical arrangement as shown in FIG. 18 may be employed for moving the slider arm 37 between the first and second locations in an alternate sequential fashion. The slider arm 37 is mounted to the enclosure 30 by two coil springs 69 and 70 located adjacent to the two ends of the slider arm 37. A jacketed cable 71 is connected to the center of the slider arm 37. The lower end of the jacketed cable 71 is connected to a double action latch 72 provided in a foot-operable casing 73. The double action latch 72 is similar in construction to a double action door latch and it is operable to latch at a first upper location and at a lower location alternately and sequentially by stepping the casing 73.

It will be appreciated by those skilled in the art that the above mechanisms for operating the slider arm in the vertical manner may be positioned 90 degrees to provide the sideway operation of the single slider arm 24 for the embodiment when the opened slot is formed at the top edge of the envelopes 11.

While the preferred embodiments of the invention have been described above. It will be recognized and understood that various modifications may be made therein and the appended claims are intended to cover all such modifications which may fall within the spirit and scope of the invention.

What I claim is:

1. A method of turning a plurality of music sheets automatically, comprising creating a stack of a plurality of transparent envelopes having an opened end, two closed side edges, and a closed bottom end opposite to said opened end, mounting said closed end of said envelopes to an elongated rod whereby said are turnable relative to said rod, said rod having two ends extending beyond said two closed side edges of said stack, forming an opened slot in a selected one edge portion of said opened end and two closed side edges of said envelopes, said opened slot being formed at a first location for odd numbers of said envelopes and at a second location for even numbers of said envelopes, mounting said music sheets in a sequential manner, one sheet in one envelope, into said envelopes, mounting said stack on a top forward leaning upper frame with said elongated rod positioned in a substantially horizontal manner and with said two ends therein rotatably engaging with mounting brackets positioned adjacent to a lower end of said upper frame, mounting a slider arm on said upper frame, said slider arm having a short finger extending over said one edge portion, and said slider arm being operable to slide between said first location and said second location alternately to cause said envelopes to turn downward by gravitational force one at a time to fall on to a lower display frame to display said music sheets one at a time sequentially.

2. A method according to claim 1 wherein said opened slot is formed in said opened end of said envelopes.

3. A method according to claim 1 wherein said opened slot is formed at both closed side edges of said envelopes.

4. A device for holding a plurality of music sheets and operative for displaying said music sheets sequentially one at a time, comprising a stack of a plurality of transparent envelopes having an opened top end, a closed bottom end, and two closed side edges, said envelopes being attached to an elongated rod having two end portions extending beyond said side edges of said envelopes, said envelopes being adapted for enclosing said music sheets in a sequential manner with one music sheet located in one envelope, said elongated rod being adapted for rotatably mounting in a horizontal manner to a lower end of a top forward leaning upper frame, at least one opened slot formed at a selected one edge portion of said opened top end and said closed side edges of said envelopes, said opened slot being formed at one location in odd number of said envelopes and being formed at a second location in even number of said envelopes, and being engageable with a finger of a slider arm slidably mounted on said upper frame, said finger extending over said one edge portion and being movable slidably between said first location and said second location to cause said envelopes to turn downwards, by gravitational force, one page at a time from said upper frame to a lower display frame for displaying said music sheets one sheet at a time in a sequential manner.

5. An automatic sheet turning device operative for displaying a plurality of music sheets in a sequential manner one sheet at a time, comprising a stack of a plurality of transparent envelopes having an opened top end, a closed bottom end, and two closed side edges, said closed bottom end of said envelopes being mounted to an elongated rod, said elongated rod having two end portions extending beyond said two side edges of said envelopes, said envelopes being adapted for enclosing said music sheets therein one sheet in one envelope in a sequential manner, a first opened slot formed at a first location of said opened top end of odd number of said envelopes, a second opened slot formed at a second location of said opened top end of even number of said envelopes, said stack being mounted to a top forward leaning upper frame with said elongated rod extending in a substantially horizontal manner and with said two end portions therein rotatably engaged with two mounting brackets positioned at a lower end of said upper frame, a slider arm slidably mounted to said upper frame, said slider arm having a finger member extending over a top edge portion of said stack, said finger having a length shorter the length of said first opened slot and said second opened slot and being slidable to position between said first location and said second location alternately and sequentially to cause said envelopes to turn downwards to a lower display frame, one envelope at a time for displaying said music sheets one sheet at a time in a sequential manner.

6. An automatic sheet music turning device operative for displaying a plurality of music sheets in a sequential manner one sheet at a time, comprising a stack of a plurality of transparent envelopes wherein each envelope has an opened top end, a closed bottom end, and two closed side edges, said closed bottom end of said envelopes being attached to an elongated rod, and said elongated rod having two end portions extending beyond said two closed side edges respectively of said envelopes, said envelopes being adaptable for enclosing said music sheets therein with one music sheet in one envelope in a sequential manner, a first pair of opened slots formed at a first location at said two closed side edges of odd number of said envelopes, a second pair of opened slots formed at a second location at said two closed side edges of even number of said envelopes, said first pair of opened slots being offset from said second pair of opened slots, said stack of enveloped being mounted to a top forward leaning upper frame with said elongated rod located in a substantially horizontal position and with said two end portions of said elongated rod rotatably engaged with two mounting brackets located at a lower end of said upper frame, a slider arm slidably mounted to said upper frame, said slider arm having two finger members extending over an edge portion of said two closed side edges of said stack of said envelopes, said slider arm being operative for slidably positioning said two finger members between said first location and second location alternately and sequentially to cause said envelopes to turn downwards, by gravitational force, to a lower display frame, one envelope at a time for displaying said music sheets one sheet at a time in a sequential manner.

7. An automatic music sheets turning device according to claim 6 wherein said mounting brackets are inverted U-shaped brackets located at two lower corners of said upper frame.

8. An automatic music sheets turning device according to claim 7 wherein said finger members are shorter in length than said opened slots, and are extending in a cantilever manner over said edge portions of said two closed side edges of said stack of envelopes mounted on said upper frame.

9. An automatic music sheets turning device according to claim 8 wherein said slider arm includes two side sections slidably engaging with two side edges of said upper frame, a vertical channel formed in each one of said two side edges of said upper frame, a vertical ridge formed in each one of said two side sections of said slider arm, said vertical ridge extending inwardly towards said two side edges of said upper frame and being slidably engaged with said channel.

10. An automatic music sheets turning device according to claim 9 including a sleeve bracket located at a rear surface of said lower display frame, and being adaptable to receive a mounting pin to be inserted removably therein for mounting said device to a music stand.

11. An automatic music sheets turning device according to claim 9 including a second sleeve bracket located at a rear surface of said upper frame, and being adaptable to receive a mounting pin to be inserted removably therein for mounting said device to a music stand.

12. An automatic music sheets turning device according to claim 10 including a plurality of pairs of dimples formed at a lower portion of said two side edges of said upper frame and adaptable for removably attaching a docking plate to said upper frame for mounting said device on a piano and the like.

13. An automatic music sheets turning device according to claim 12 wherein said docking plate comprises a plate member having two L-shaped brackets mounted at two side edges of a front end therein, said L-shaped bracket having a lower section and an upper section extending at an obtuse angle relative to one another, a plurality of pairs of protrusions formed in an inner surface of said upper section of said L-shaped brackets, said upper section of said L-shaped brackets being slidably engageable with said lower portion of said two side edges of said upper frame with said pairs of protrusions engageable with selective pairs of dimples on said docking plate for maintaining said docking plate at a selected position relative to said upper frame.

14. An automatic music sheets turning device according to claim 13 including a plurality of suction cup members located at a lower surface of said docking plate and being adaptable for removably mounting said device to a top cover of said piano and the like.

15. An automatic music sheets turning device according to claim 14 including an electromechanical mechanism provided in an enclosure mounted at a rear surface of said upper frame,.

16. An automatic music sheets turning device according to claim 15 wherein said electromechanical mechanism includes a worm shaft threadingly engaged with a threaded opening formed in said slider arm, said worm shaft being coupled to a drive shaft of a DC motor, said DC motor being operative for moving said slider arm to position said finger members between said first location and second location respectively, a first limit switch positioned at a first limit location in said enclosure, and a second limit switch positioned at a second limit location in said enclosure, said first limit switch being operated by said slider arm when said finger members are positioned at said first location, and said second limit switch being operated by said slider arm when said finger members are positioned at said second location.

17. An automatic music sheets turning device according to claim 16 including a battery compartment in said enclosure for housing a battery for supplying electrical power for operating said DC motor, said DC motor and said first limit switch and said second limit switch and said battery being electrically connected to an electrical connection terminal block, a switching means electrically and removably connected to said connection terminal block through a connection socket and a connection plug.

18. An automatic music sheets turning device according to claim 17 wherein said switching means is selected from a group of switches consisting of a foot-operated switch, a push button switch, and a wireless remote control switch.

19. An automatic music sheets turning device according to claim 15 wherein said electromechanical mechanism comprises a worm shaft positioned in an enclosure mounted at a rear surface of said upper frame, a threaded opening formed in said slider arm, said slider arm being coupled to said worm shaft through a threaded opening, a stepper motor having a drive shaft connected to said worm shaft and being operative for rotating said worm shaft selectively in a first direction for moving said finger members to said first location, and in a second direction for moving said finger members to said second location, electronic control board means located in said enclosure and adapted to operate said stepper motor, and switching means connectable to said electronic control board means for operating said stepper motor to move alternately in back and forth directions.

20. An automatic music sheets turning device according to claim 14 including a mechanical mechanism adapted for operating said slider arm, said mechanical mechanism comprising two coil springs mounted between two ends of said slider arm and said enclosure, a jacketed cable mounted to said enclosure, said cable having an inner sliding cable having one end connected to said slider arm and a lower end connected to a double action latch located in a foot-operated casing, said casing being operative for alternately and sequentially moving said slider arm for positioning said finger members between said first location and said second location.

21. An automatic music sheets turning device according to claim 18 including a cut out formed at a top edge of said upper frame.

22. An automatic music sheets turning device according to claim 21 wherein said upper frame and said lower display frame are hingedly connected to one another and operative for positioning said upper frame and said lower display frame at a selected angular position relative to one another.

23. An automatic music sheets turning device according to claim 22 wherein said slider arm extends outwards through two openings formed in two sides of said enclosure, said openings having a length facilitating said slider arm to move up and down for positioning said finger members between said first location and said second location.

* * * * *